US005691121A

United States Patent [19]

Dewanckele et al.

[11] Patent Number: 5,691,121

[45] Date of Patent: Nov. 25, 1997

[54] METHOD FOR MAKING NEGATIVE LITH IMAGES DIRECT POSITIVE IMAGES

[75] Inventors: Jean-Marie Dewanckele, Drongen; David Terrell, Lint; Hieronymus Andriessen, Beerse; Kris Viaene, Bonheiden, all of Belgium

[73] Assignee: AGFA-Gevaert. N.V., Mortsel, Belgium

[21] Appl. No.: 680,358

[22] Filed: Jul. 15, 1996

Related U.S. Application Data

[63] Continuation-in-part of Ser. No. 532,052, Sep. 22, 1995, abandoned.

[30] Foreign Application Priority Data

Sep. 27, 1994 [EP] European Pat. Off. ..... 94202772

[51] Int. Cl.[6] ..... G03C 1/73

[52] U.S. Cl. ..... 430/410; 430/598; 430/940

[58] Field of Search ..... 430/378, 406, 430/410, 412, 547, 596, 597, 598, 940

[56] References Cited

U.S. PATENT DOCUMENTS

| | | | |
|---|---|---|---|
| 4,789,627 | 12/1988 | Inoue et al. | 430/410 |
| 4,801,520 | 1/1989 | Inoue et al. | 430/598 |
| 4,835,091 | 5/1989 | Inoue et al. | 430/410 |
| 4,863,839 | 9/1989 | Heki et al. | 430/410 |
| 4,871,653 | 10/1989 | Inoue et al. | 430/410 |
| 5,035,993 | 7/1991 | Hirano et al. | 430/598 |
| 5,338,658 | 8/1994 | Hirano | 430/598 |
| 5,372,911 | 12/1994 | Obi et al. | 430/264 |

*Primary Examiner*—Hoa Van Le
*Attorney, Agent, or Firm*—Breiner & Breiner

[57] ABSTRACT

A photographic light-sensitive silver halide material is provided for making negative lithographic images or direct-positive images, said material comprising a support, at least one internal latent image-type silver halide emulsion layer (in the case of direct-positive materials) or surface latent image-type silver halide emulsion layer (in the case of lithographic materials) and development-nucleating amounts of a compound or a precursor thereof, said compound having at least one quaternary heterocyclic ring system comprising at least three rings including a tetrahydropyridinium ring wherein carbon-nitrogen and carbon-carbon double bonds are also part of an aromatic ring being one of said three rings and wherein said double bonds and nitrogen atom in said tetrahydropyridinium ring are incorporated into annelated conjugated ring systems. Developing said photographic material after exposure in an alkaline surface developer rapidly converts said precursor into a ring system as defined hereinbefore.

10 Claims, No Drawings

METHOD FOR MAKING NEGATIVE LITH IMAGES DIRECT POSITIVE IMAGES

This is a continuation in part application of Ser. No. 08/532,052, filed Sep. 22, 1995, now abandoned.

1. FIELD OF THE INVENTION

The present invention relates to a method for making direct-positive images or lith images by developing photographic light-sensitive silver halide materials in the presence of new stable development nucleators that do not cause unevenness of development and to a photographic light-sensitive silver halide material for forming direct-positive images having a high maximum density and low rereversal or lith images having low fog level and high contrast.

2. BACKGROUND OF THE INVENTION

In silver halide photography a photographic method, according to which a negative image is formed, e.g., for lithographic applications requiring a low fog level and a high contrast, is well-known. Opposite thereto a method according to which a positive image is made without the use of a negative image or an intermediary process producing a negative image, is called a direct-positive method. A photographic light-sensitive material and a photographic emulsion for use according to such photographic method are called direct-positive material and direct-positive emulsion respectively. A variety of direct-positive photographic methods are known. The most useful methods are the method, which comprises exposing prefogged silver halide grains to light in the presence of a desensitizing agent and developing them, and the method, which comprises subjecting a silver halide emulsion containing silver halide grains that have light-sensitive specks mainly inside the grains to an imagewise exposure and developing the exposed emulsion in the presence of a development nucleator. The present invention relates to the latter method. A silver halide emulsion comprising light-sensitive specks mainly inside the grains and which forms latent images mainly inside the grains is referred to as internal latent image-type silver halide emulsion, and thus is distinguished from silver halide grains that form latent images mainly at the surface of the grains that are providing negative images.

It is known to develop a latent image that has been formed mainly inside the grains by means of a so-called internal developer, but the method, material, and emulsions used in accordance with the present invention are not concerned with that type of development, but rather with the type of development using a so-called surface developer, as is applied also for lithographic materials, offering a negative image.

Methods for making a direct-positive image by development of an exposed internal latent image type-silver halide emulsion in the presence of a development nucleator by means of a surface developer, and photographic emulsions and photographic light-sensitive materials used in such methods have been disclosed in i.a. GB-A 1,011,062, 1,151,363, 1,195,837, in JA Patent Publication No. 29,405/68, and in U.S. Pat. Nos. 2,456,953, 2,497,875, 2,497,876, 2,588,982, 2,592,250, 2,675,318, 3,227,552, 3,761,276, 4,540,655.

In the internal latent image-type method for making a direct-positive image, the development nucleator may be incorporated into a developing solution, but is usually incorporated into the photographic emulsion layer or in another layer of the photographic light-sensitive material. Development nucleators that can be used in the above-described method for making a direct-positive image include hydrazine and derivatives thereof as described in i.a. "Zeitschrift für Wissenschaftliche Photographie" by Arens, vol. 48, (1953) p.48, DE-A 3,021,423, and in U.S. Pat. Nos. 2,563,785; 2,588,982; 3,227,552; 4,245,037; 4,374,923; 4,540,655; 5,155,014; WO 91/03765; in Research Disclosure 23510, p. 346–348 and the documents referred to therein.

A review of suitable hydrazide-type development nucleators for use in direct-positive applications as described hereinbefore is given in U.S. Pat. No. 5,254,443, which is incorporated herein by reference (see formulae N-1 to N-8). Further new hydrazide-type development nucleators have more recently been described in EP-A 0 634 692.

Such hydrazides exhibit nucleating behaviour which is strongly pH-dependent with little nucleation activity at pH values below 10.5.

Heterocyclic salts having a propargyl substituent such as disclosed in U.S. Pat. No. 4,115,112; 4,306,106; 4,828,973 and 4,877,723, on the other hand, exhibit nucleating behaviour which is much less strongly pH-dependent, with nucleation activity being observed in a methol-ascorbic acid developer with a pH of 9.6.

However, propargyl quinaldine, a representative of this class of nucleating agents, exhibits poor nucleation discrimination between exposed and unexposed silver halide grains as shown by high minimum density values and strong rereversal.

Nucleating agents comprising a 1,2-dihydroaromatic heterocyclic ring nucleus with a quaternary nitrogen atom with the general formula:

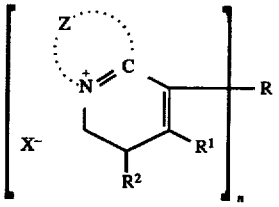

have been disclosed in RD 9203 (1971) and in U.S. Pat. No. 3,719,494.

This type of compounds has been mentioned frequently in subsequent U.S. Pat. Nos. as e.g. in U.S. Pat. Nos. 4,954,427; 4,871,653 and 4,395,478. Such compounds are thought to be formed upon the ring closure of N-propargyl heteroaromatic cyclic compounds in alkaline developers and to be the active nucleating species when such compounds are employed as nucleating agents.

A new type of dihydropyridinium precursors has been recently disclosed in JP-A 4,000,437 wherein an inactive compound A is converted into an active compound B upon reaction with the hydroxyl ions present in alkaline developers:

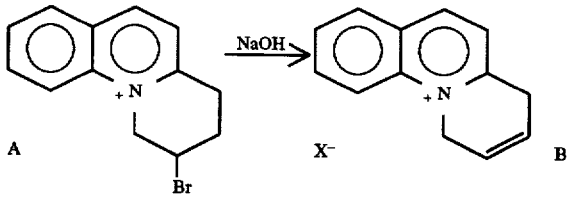

However, development nucleators, such as hydrazides, N-propargyl heteroaromatic cyclic compounds or the compounds of JP-A 4,000,437, which are converted into an active nucleating species in alkaline developers exhibit delayed nucleating activity, the delay being dependent upon the rate at which the active species is formed. This delay is observable with spectrophotometry as described by D. L. Kerr in the extended abstracts of the IS&T's 4th Annual Conference in 1993, pages 268 to 270.

On the other hand development nucleators such as the 1,2-dihydroaromatic heterocyclic compounds with a quaternary nitrogen atom disclosed in RD 9203 (1971), exhibit immediate nucleating activity in alkaline developers, but exhibit nucleating activity in the silver halide material during storage, which is undesirable, or are unstable. This leads to reduced maximum density, higher minimum densities and increased rereversal in the unexposed silver halide materials upon storage.

3. OBJECTS OF THE INVENTION

It is therefore an object of the present invention to provide a method for making direct-positive images or negative lithographic images, further called "lith images", by developing photographic light-sensitive silver halide materials in the presence of low amounts of very stable and efficient development nucleators which exhibit immediate nucleating activity in alkaline developers, are active in developers with a pH value below 10 and do not cause unevenness of development.

It is another object of the present invention to provide a photographic light-sensitive silver halide material for forming direct-positive images or lith images having a high maximum density, low minimum density and a high gradation.

It is a further object of the present invention to provide a photographic light-sensitive silver halide material for forming direct positive images exhibiting minimum degradation in maximum density or lith images exhibiting minimum decrease in contrast and retention sensitivity upon storage.

It is a further object of the present invention to provide compounds acting as novel development nucleators.

Other objects of the present invention will become apparent from the description hereinafter.

4. SUMMARY OF THE INVENTION

It has been found now that the above objects are accomplished by a method for making negative lithographic images or direct-positive images by the steps of image-wise exposing a photographic light-sensitive silver halide material comprising a support, at least one internal latent image-type silver halide emulsion layer (in the case of direct-positive materials) or surface latent image-type silver halide emulsion layer (in the case of lith materials) and development-nucleating amounts of a compound or a precursor thereof ranging from about $10^{-5}$ to about $10^{-1}$ mole per mole of silver halide, said compound having at least one quaternary heterocyclic ring system comprising at least three rings including a tetrahydropyridinium ring wherein carbon-nitrogen and carbon-carbon double bonds are also part of an aromatic ring being one of said three rings and wherein said double bonds and nitrogen atom in said tetrahydropyridine ring are incorporated into annelated conjugated ring systems; and developing said exposed photographic material in an alkaline surface developer, wherein said precursor is rapidly converted into a ring system as defined hereinbefore.

Compounds that can be used advantageously as new development nucleator precursors in accordance with the present invention correspond to one of the general formulae I, II and III:

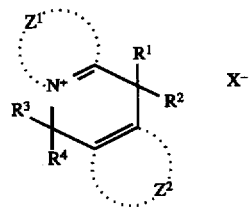

(I)

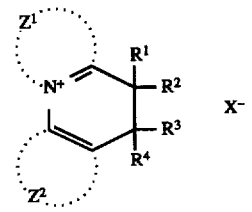

(II)

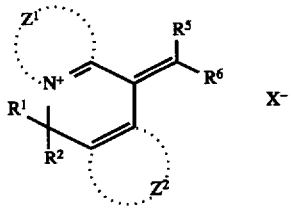

(III)

wherein:

$Z^1$ represents the carbon atoms necessary to complete a conjugated nucleus containing from 5 to 6 atoms including the quaternary nitrogen atom;

$Z^2$ represents the carbon atoms necessary to complete a conjugated ring;

$R^1$, $R^2$, $R^3$,$R^4$, $R^5$ and $R^6$ are independently an (unsubstituted or substituted) alkyl, amino, acyl, carboxy, sulfonyl, halide, sulfinyl group or hydrogen with the proviso that one of $R^1$ and $R^2$; one of $R^3$ and $R^4$ and one of $R^5$ and $R^6$ is hydrogen.

Preferred variants of $Z^1$ and/or $Z^2$ are ring systems substituted with a group containing a blocked silver halide adsorbing group, which is rapidly deblocked in alkaline developers by hydrolysis due to the action of hydroxyl ions present therein.

In a preferred embodiment the group containing a blocked silver halide adsorbing group is represented by formula IV:

$$—R^7—S—R^8 \qquad \text{IV}$$

wherein $R^7$ represents —NH—CO—$CH_2$—; —CO—$CH_2$—: —NH—$CH_2$—; —NH—$SO_2$—$CH_2$—;

$R^8$ represents a thiocarbamide group, a carbamide group, an acyl group, a thionyl group, a carboxy carbonyl group or a carboxy-thiocarbonyl group.

Moreover $Z^1$ and/or $Z^2$ preferably are ring systems substituted with a group containing a blocked silver halide adsorbing group, which is rapidly deblocked in alkaline developers by hydrolysis as set forth above. Examples thereof are compounds I.3, I.4, II.2 and II.3 given further in the detailed description.

The present invention also provides a photographic light-sensitive silver halide material for forming direct-positive images, said material comprising a support and in at least one light-sensitive emulsion layer comprising unfogged internal latent image-type silver halide grains dispersed in a hydrophilic colloid binder and/or in a hydrophilic colloid layer in water-permeable relationship with said emulsion layer, development-nucleating amounts of at least one compound according to this invention, characterized in that said compound corresponds to one of the above defined general formulae I to III, I and II being a compound with a tetrahydropyridinium ring and III being a compound capable of being converted into a corresponding compound with a tetrahydropyridinium ring by the presence of hydroxyl ions in the alkaline developer.

The present invention further provides as novel nucleators compounds corresponding to one of the above general formulae I to III.

5. DETAILED DESCRIPTION OF THE INVENTION

Nucleators according to the general formulae I and II and nucleator precursors according to the general formula III are used instead of propargylammonium compounds and the classic hydrazides such as e.g. phenylformylhydrazide. Under the influence of hydroxyl ions present in the alkaline developer a conversion takes place from the inactive form according to the general formula III present in the slightly acidic layer of the material to the active form according to the general formula IIIa:

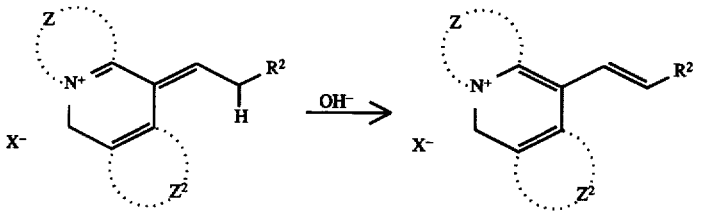

III IIIa

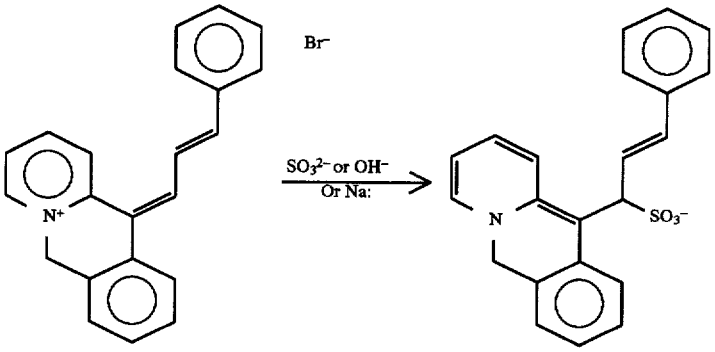

Representatives of development nucleators or precursors thereof according to the present invention are the following compounds corresponding to the general formulae I, II and III are:

I.1

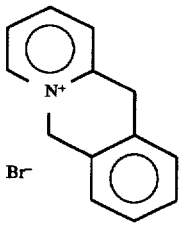

-continued

I.2

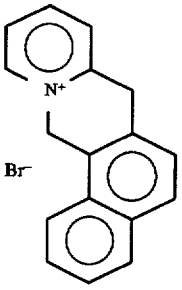

-continued

I.3

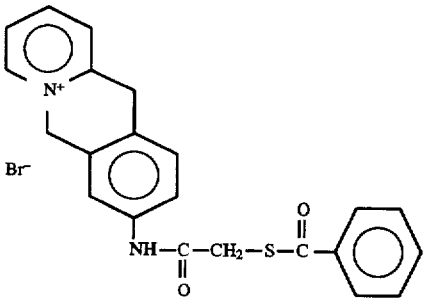

-continued

I.4

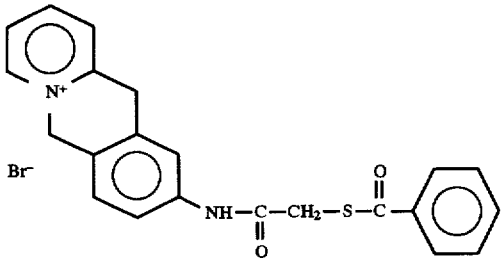

II.1

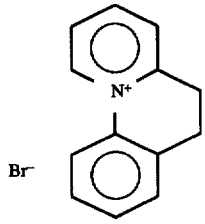

II.2

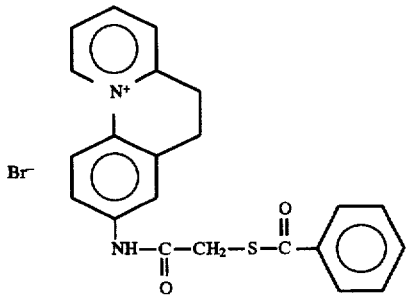

II.3

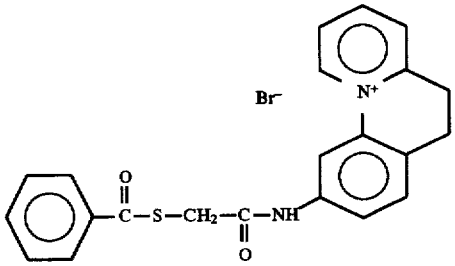

III.1

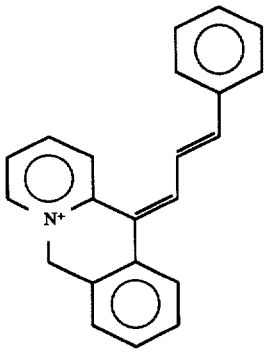

The synthesis of the dihydrobenzoquinolizinium compounds I.1 and I.2 has been described by L. L. Braun and C. K. Bradsher in J. Org. Chem., Vol. 33, 1296–1299,(1968).

In the compounds used according to the present invention both double bonds of the tetrahydropyridinium ring present in compounds with formulae I and II, or generated in alkaline developers in the case of compounds of formula III, are stabilized by themselves being part of aromatic rings, whereas in the case of compounds according to Research Disclosure 9203 (1971) and U.S Pat. No. 3,719,494 only one of the double bonds is so stabilized. Furthermore the involvement of the both double bonds of the "tetrahydropyridinium ring" in aromatic rings precludes the conjugation of the two double bonds thereby stabilizing the compounds with formulae I and II and the tetrahydropyridinium compounds generated in alkaline developers from compounds with formula III against oxidation to aromatic compounds. Both effects result in improved chemical stability of the "tetrahydropyridinium compounds" according to formulae I and II and of the tetrahydropyridinium compounds generated in alkaline developers from compounds with formula III.

Although a tetrahydropyridinium skeleton is also preferred in EP-A 0 381 160, e.g. N-I-4, its structures remain different from the structures presented in this invention, and related thereto also its activity in the conditions wherein the compounds according to this invention are used. Further even in the occasional presence of a tetrahydropyridinium skeleton as in EP-A 0 518 352, compound N-44, the differences in aromatic ring substitution remain and differences in the conjugation system make the activity of this compound different from those according to the embodiments of this invention.

One or more compounds used according to the present invention can be incorporated into the developer or in a prebath applied to the exposed photographic material before development thereof. Preferably however one or more of the stable compounds of the present invention are incorporated into the silver halide emulsion layer or into a hydrophilic colloid layer in water-permeable relationship therewith.

The compounds used according to the present invention may also be used in admixture with one another or with other known nucleating agents such as hydrazides e.g. phenylformylhydrazides, propargyl-ammonium compounds etc. and incorporated for that purpose e.g. into the light-sensitive silver halide emulsion layer or into a hydrophilic colloid layer in water-permeable relationship therewith.

When used in the silver halide emulsion layer the compounds of the present invention are preferably present in a concentration of $1.10^{-5}$ to $1.10^{-1}$ mole per mole of silver halide.

Prior to the coating of the composition that will form the photographic layer comprising at least one development nucleator, the development nucleator(s) and/or nucleator precursor(s) can be dissolved in an organic solvent and added to said composition. For instance, $1.3\times10^{-3}$ mole of the nucleator or nucleator precursor(s), optionally in the presence of one or more other nucleators or nucleator precursors, can be added in the form of a 3.5% solution in N-methyl-pyrrolidone per mole of silver halide.

According to a preferred embodiment the development nucleator(s) and/or nucleator precursor(s) are added in dispersed form to the hydrophilic colloid composition that will form said emulsion layer or said hydrophilic colloid layer. When these "tetrahydropyridinium" compounds (which can also be considered as "dihydroacridizinium" compounds) are present in dispersed form in a hydrophilic colloid layer, preferably in the internal latent image-type silver halide emulsion layer, the direct-positive images obtained upon development have a very fine grain.

The development nucleator(s) and/or nucleator precursor (s), optionally in the presence of one or more other nucleators, can be incorporated into the hydrophilic colloid composition that will form said emulsion layer or said hydrophilic colloid layer by dissolving them first in at least one water-immiscible, oil-type solvent or oil-former, adding the resulting solution to an aqueous phase containing a hydrophilic colloid preferably gelatin and a dispersing agent, passing the mixture through a homogenizing apparatus so that a dispersion of the oily solution in an aqueous medium is formed, mixing the dispersion with a hydrophilic colloid composition e.g. a gelatin silver halide emulsion, and coating the resulting composition in the usual manner to produce a system in which particles of development nucleator(s) and/or nucleator precursor(s) and optionally one or more other nucleators, surrounded by an oily membrane, are distributed throughout the gel matrix. The dissolution of said precursor(s) and nucleator(s) in the oil-former may be facilitated by the use of an auxiliary low-boiling water-immiscible solvent, which is removed afterwards by evaporation.

The nucleator(s) and/or nucleator precursor(s) can be dispersed in hydrophilic colloid compositions with the aid of at least one known oil-former e.g. an alkyl ester of phthalic acid. The oil-formers can be used in widely varying concentrations e.g. in amounts ranging from about 0.1 to about 10 parts by weight and preferably from 0.5 to 2 parts by weight relative to the amount of the development nucleator (s) and/or nucleator precursor(s) dispersed therewith.

It may be useful to combine the oil-former with at least one auxiliary solvent that is insoluble or almost insoluble in water and has a boiling point of at most 150° C., such as a lower alkyl acetate e.g. ethyl acetate.

According to another embodiment of the present invention the nucleator(s) and or nucleator precursor(s) are incorporated into the hydrophilic colloid composition that will form said silver halide emulsion layer or said hydrophilic colloid layer by mixing the nucleator(s) and/or nucleator precursor(s) in the absence of an oil-former and a solvent with an aqueous hydrophilic colloid solution, preferably an aqueous gelatin solution, passing the resulting mixture through a homogenizing apparatus, adding the dispersion obtained to said hydrophilic colloid composition that will form said emulsion layer or said hydrophilic colloid layer, and coating said hydrophilic colloid composition on a support.

The homogenizing apparatus can be any of the devices currently used for making dispersions e.g. an ultrasonic power generator, a mill such as a ball mill, a sand mill, and a colloid mill.

In the photographic light-sensitive direct-positive material according to the present invention the development nucleator(s) and/or nucleator precursor(s) is(are) preferably present in the internal latent image-type silver halide emulsion layer. However, the nucleator precursor(s) can also be incorporated into a hydrophilic colloid layer that stands in water-permeable relationship with the internal latent image-type silver halide emulsion layer, e.g., in a protective hydrophilic colloid layer having a thickness in dry state of 1 to 3 μm. The hydrophilic colloid layer can be any layer that makes part of the photographic light-sensitive direct-positive material according to the present invention. It can thus be i.a. a light-sensitive layer, an intermediate layer, a filter layer, a protective layer, an antihalation layer, an antistress layer, a subbing layer, or any other layer. In other words, any layer will satisfy provided the nucleator(s) and/or nucleator precursor(s) is(are) not prevented from diffusing to the internal latent image-type silver halide emulsion layer.

The nucleator(s) and/or nucleator precursor(s) used according to the present invention preferably is (are) incorporated into the layer(s) in an amount that yields satisfactory maximum density values of e.g. at least 1.50 when the internal latent image-type emulsion is developed with a surface-developing solution. The amount may vary within wide limits and depends upon the nature of the silver halide emulsion, the chemical structure of said nucleator(s) and/or nucleator precursor(s), and on the developing conditions. Nevertheless, an amount of from about 0.01 to about 100 mmole per mole of silver halide in the internal latent image-type silver halide emulsion is generally effective, more preferably an amount of from about 0.1 to about 10 mmole per mole of silver halide. When the nucleator(s) and/or nucleator precursor(s) is(are) incorporated into a hydrophilic colloid layer that stands in water-permeable relationship with the internal latent image-type silver halide emulsion layer, it is adequate to incorporate the nucleator precursor(s) in the above amounts while taking into account the amount of silver contained in the associated internal latent image-type emulsion layer.

An internal latent image-type silver halide emulsion is an emulsion, the maximum density of which obtained when developing it with an "internal type" developing solution exceeds the maximum density that is achievable when developing it with a "surface-type" developing solution.

Internal latent image-type silver halide emulsions that can be used in accordance with the present invention have been described in e.g. U.S. Pat. Nos. 2,592,250; 3,206,313; 3,271,157; 3,447,927; 3,511,662; 3,737,313; 3,761,276; GB-P 1,027,146, and JA Patent Publication No. 34,213/77. However, the silver halide emulsions used in the present invention are not limited to the silver halide emulsions described in these documents.

The internal latent image-type silver halide emulsions that are suited for use according to the present invention are emulsions that have not been prefogged externally and that have either been ripened chemically or not.

The photographic emulsions, negative working as well as direct-positive working emulsions, can be prepared according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966).

The photographic silver halide emulsions used according to the present invention can be prepared by mixing the halide and silver solutions in partially or fully controlled conditions of temperature, concentrations, sequence of addition, and rates of addition. The silver halide can be precipitated according to the single-jet method, the double-jet method, or the conversion method. The conversion method has proved to be particularly suitable. According to this method a more soluble silver halide is converted into a less soluble silver halide. For instance a silver chloride emulsion is converted in the presence of water-soluble bromide and possibly iodide, the amounts of which are selected with regard to the finally required composition, into a silver chlorobromoiodide or a silver bromoiodide emulsion. This conversion is preferably carried out very slowly in several consecutive steps i.e. by converting a part of the more soluble silver halide at a time. Another technique by which emulsions with an increased internal latent image sensitivity can be prepared has been described in GB-P 1,011,062.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in the method of the present invention.

The average size of the silver halide grains may range from 0.1 to 2.0 μm, preferably from 0.15 to 0.8 μm and still more preferably from 0.20 to 0.50 μm.

The size distribution of the silver halide particles of the photographic emulsions used according to the present invention can be homodisperse or heterodisperse. A homodisperse size distribution is obtained when 95% of the grains have a size that does not deviate more than 30%, and more preferably not more than 20%, from the average grain size.

In addition to silver halide the emulsions may also comprise organic silver salts such as e.g. silver benzotriazolate and silver behenate. The silver halide crystals can further be doped with $Rh^{3+}$, $Ir^{4+}$, $Cd^{2+}$, $Zn^{2+}$, $Pb^{2+}$, $Fe^{2+}$ etc.

Preferred latent image-forming silver halide emulsions are so-called core-shell emulsions consisting of a core and at least one shell with the same or different halide compositions. Both shell and core can mutually independently be composed of silver bromide, silver chloride, silver chlorobromide, silver chloroiodide, silver bromoiodide and silver chlorobromoiodide. The emulsions can show a coarse, medium or fine average grain size and be bounded by (100), (111), (110) crystal planes or combinations thereof. Also high aspect ratio tabular core-shell emulsion grains are possible as disclosed in U.S. Pat. No. 4,504,570. The core-shell emulsions contain internal sensitization sites which can be of various nature and which form an internal latent image upon exposure.

A first type of core-shell emulsions contains internal physical sensitization sites formed by crystallographic irregularities in the phase boundaries between a core and a shell of distinctly different halide composition as e.g. a silver bromide core and a silver bromoiodide shell with a relative high iodide percentage.

Another simple method of obtaining internal sensitization sites consists of incorporating a polyvalent metal ion dopant in the core grains during their formation. This metal dopant can be placed in the reaction vessel prior to precipitation or it can be added to one or more of the solutions involved in the precipitation. Preferred polyvalent metal dopants are elements of group VIII of the Periodic System, e.g. Iridium, as disclosed in U.S. Pat. No. 3,367,778, or Rhodium. They are preferably used in the form of a soluble salt or coordination complex. The usual concentration range comprises between $10^{-8}$ and $10^{-4}$ mole per mole of silver halide.

The most common method of creating internal sensitization sites consists of interrupting the precipitation after finishing the precipitation of the core, then chemically sensitizing or even fogging this core, and then precipitating the shell. The usual chemical ripening agents containing middle-chalcogen elements like sulphur, selenium and tellurium can be used as was disclosed e.g. in U.S. Pat. No. 3,761,276, preferably in combination with compounds containing noble metal atoms, e.g. gold. Contrast can be controlled by optimizing the ratio of middle-chalcogen amount to gold sensitizer amount as is described in U.S. Pat. No. 4,035,185.

The choice of the halide composition of the shell portion will depend on the requirements of the specific photographic application. In order to achieve fast developability emulsion shells with a high chloride content are desirable. On the contrary when high sensitivity is most important bromide or iodobromide grain shells are preferred. The shell portion of the grain must comprise a sufficient percentage of the total silver halide to avoid access of a surface developer to the internal sensitization centers. The surface of the finished core-shell emulsion grains may or may not be chemically sensitized in the case of direct-positive emulsions. For obtaining good reveral speed and maximum density a moderate degree of surface sensitization using conventional techniques may be applied. This degree of chemical sensitization is limited to that which will realize an optimal balance between internal and surface sensitivity, the internal sensitization usually remaining predominant. For negative working emulsions it is clear that the chemical ripening should be optimized to get sensitivity specks at the surface of the grains in order to have a surface sensitivity that amply exceeds internal sensitivity.

The emulsion can be left unwashed or it can be desalted using conventional techniques e.g. by dialysis, by flocculation and re-dispersing, or by ultrafiltration.

Chemical sensitization at the crystal surface of the emulsion grain can be performed as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines as well as in the presence of the corresponding selenium and tellurium compounds. The emulsions can also be sensitized by means of gold-sulphur ripeners or by means of reductors e.g tin compounds as described in GB-A 789,823, amines, hydrazinc derivatives, formamidine-sulphinic acids, and silane compounds. Chemical sensitization can also be performed with small amounts of Ir, Rh, Ru, Pb, Cd, Hg, Tl, Pd, Pt, or Au. Any one of these chemical sensitization methods or a combination thereof can be used.

The spectral photosensitivity of the silver halide can be adjusted by sensitization to any desired spectral range between 300 and 900 nm e.g. to blue light of relatively long wavelengths, to green light, to red light, to infrared light, by means of the usual mono- or polymethine dyes such as acidic or basic cyanines, hemicyanines, oxonols, hemioxonols, styryl dyes or others, also tri- or polynuclear methine dyes e.g. rhodacyanines or merocyanines. Such spectral sensitizers have been described by e.g. F. M. Hamer in "The Cyanine Dyes and Related Compounds" (1964) Interscience Publishers, John Wiley & Sons, New York. The spectral photosensitivity of the silver halide can also be adjusted for exposure by laser light e.g. helium-neon laser light, argon laser light, and solid state laser light. Dyes that can be used for adjusting the photosensitivity to laser light have been described in i.a. JA-A 62284344, 62284345, 62141561, 62103649, 62139555, 62105147, 62105148, 62075638, 62062353, 62062354, 62062355, 62157027, 62157028, 62113148, 61203446, 62003250, 60061752, 55070834, 51115821, 51115822, 51106422, 51106423, 51106425; DE-A 3,826,700; U.S. Pat. Nos. 4,501,811, 4,725,532, 4,784,933; GB-A 1,467,638; and EP-B 100,654 and in documents cited therein. The silver halide can also be sensitized with dyes providing a spectral sensitivity mainly in the range of 400 to 540 nm and not extending the sensitivity substantially beyond 540 nm so that the resulting photosensitive material can be handled in safe-light conditions prior to the image-wise exposure. Suitable dyes that can be used for that purpose have been described in e.g. U.S. Pat. No. 4,686,170.

Other useful sensitizing dyes that can be employed in accordance with the present invention have been described in e.g. U.S. Pat. Nos. 2,503,776, 2,526,632, 3,522,052, 3,556,800, 3,567,458, 3,615,613, 3,615,632, 3,615,635, 3,615,638, 3,615,643, 3,617,293, 3,619,197, 3,625,698, 3,628,964, 3,632,349, 3,666,480, 3,667,960, 3,672,897, 3,677,765, 3,679,428, 3,703,377, 3,705,809, 3,713,828, 3,713,828, 3,745,014, 3,769,025, 3,769,026, 3,770,440, 3,770,449, GB-P 1,404,511, and BE-A 691,807.

The sensitizing dyes employed in the present invention are used in a concentration almost equivalent to that used in ordinary negative silver halide emulsions. In particular, it is advantageous that the sensitizing dyes be employed in a dye concentration to a degree that does not substantially cause desensitization in the region of intrinsic sensitivity of the silver halide emulsion.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.e. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

Density-increasing compounds may be incorporated into the photographic light-sensitive direct-positive silver halide material, preferably into an internal latent image-type silver halide emulsion layer thereof, although they may be incorporated also into a hydrophilic colloid layer that stands in water-permeable relationship with the internal latent image-type silver halide emulsion layer e.g. in said protective hydrophilic colloid layer comprising at least 1 g of hydrophilic colloid per m2.

Suitable density-increasing compounds are formic acid, oxalic acid, glyoxylic, sulpho-salicilic acid, or salts of these, and polyethylene glycols. When incorporated into the photographic element the density-increasing compound is present in amounts of from 4 to 600 mg/m2, preferably from 40 to 300 mg/m2. When the density-increasing compound is incorporated into a hydrophilic colloid layer it is present therein in the form of a salt e.g. sodium or potassium formiate or oxalate.

It is also possible to incorporate the density-increasing compound into a hydrophilic colloid layer that does not stand in direct water-permeable relationship with the internal latent image-type silver halide emulsion layer e.g. because an impermeable support constitutes a barrier between said emulsion layer and said hydrophilic colloid layer. In that case the density-increasing compound can during treatment of the exposed material with a developing solution or a prebath diffuse via said developing solution or said prebath towards the silver halide emulsion layer and have its effect there. Such layers are e.g. layers that have been coated on the rear side of the support and which may serve different purposes. Examples of such layers are e.g. a back layer, an anti-curling layer, and an antistatic layer.

The density-increasing compound may also be added to the developing solution in amounts of from 0.2 to 30 g/l, preferably from 1 to 10 g/l. The density-increasing compound may also be added to another processing solution e.g. a prebath. When the density-increasing compound is added to the developing solution or to a prebath it is present therein in acid form or in the form of a salt.

A preferred density-increasing compound is oxalic acid, because it has the highest density-increasing effect and can thus be used in lower concentrations.

For processing the photographic material of the present invention any of the known methods can be employed. Specifically, the processing method used according to the present invention basically includes a development step and a fixing step. A stopping step and a rinsing step can be included as well, if desired. The processing temperature is usually selected within the range of from 18° C. to 50° C. However, temperatures lower than 18° C. and temperatures higher than 50° C. can be employed, if desired. The processing time may vary within broad ranges provided the mechanical strength of the materials to be processed is not adversely influenced and no decomposition takes place.

The developing solution used for developing an exposed photographic material in accordance with the present invention may comprise at least one alkanolamine, which may be chosen from primary, secondary, and tertiary alkanolamines. Suitable alkanolamines are i.a. N,N,N-triethanolamine, 2-amino-2-hydroxymethyl-propan-1,3-diol, N-methyl-diethanolamine, N-ethyl- diethanolamine, diisopropanolamine, N,N-diethanol-amine, 3,3'-amino-dipropanol, 2-amino-2-methyl-propan-1,3-diol, N-propyl-diethanolamine, N-butyl-diethanolamine, N,N-dimethyl-ethanolamine, N,N-diethyl-ethanolamine, N,N-diethyl-isopropanolamine, 1-amino-propan-2-ol, N-ethanolamine, N-methyl-ethanolamine, N-ethyl-ethanolamine, N-ethyl-propanolamine, 3-amino-propanol, 3-dimethylamino-propanol, 4-amino-butanol, and 5-amino-pentan-1-ol.

The alkanolamine or a mixture of alkanolamines may be present in the developing solution in amounts of from 1 to 100 g/l, preferably 10 to 60 g/l.

In the developing solution used in the method of the present invention, a hydroquinone alone or a combination of a hydroquinone with a secondary developing agent of the class of 1-phenyl-3-pyrazolidinone compounds and p-N-methyl-aminophenol can be used as developing agent. Specific examples of hydroquinones include hydroquinone, methylhydroquinone, t-butyl-hydroquinone, chloro-hydroquinone, and bromohydroquinone.

Particularly useful 1-phenyl-3-pyrazolidinone developing agents for use in combination with a hydroquinone are 1-phenyl-3-pyrazolidinone, 1-phenyl-4-methyl-3-pyrazolidinone, 1-phenyl-4-ethyl-5-methyl-3-pyrazolidinone, 1-phenyl-4,4-dimethyl-3-py-razolidinone, and 1-phenyl-4-hydroxymethyl-4-methyl-3-pyrazolidinone.

N-methyl-p-aminophenol and 2,4-diaminophenol can be used in combination with a hydroquinone as a developing agent.

When the secondary developing agent used in the processing method of the present invention is one of the class of the 1-phenyl-3-pyrazolidinone compounds it is preferably present in an amount of 2 to 20 g per liter. When the secondary developing agent is p-N-methyl-aminophenol it is preferably present in an amount of 10 to 40 g per liter.

The developing solution comprises a preservative such as a sulphite e.g. sodium sulphite in an amount ranging from 45 g to 160 g per liter.

The developing solution comprises alkali-providing substances such as hydroxides of sodium and potassium, alkali metal salts of phosphoric acid and/or silicic acid e.g. trisodium phosphate, orthosilicates, metasilicates, hydrodisilicates of sodium or potassium, and sodium carbonate. The alkali-providing substances can be substituted in part or wholly by alkanolamines.

The developing solution may comprise a buffering agent such as e.g. sodium or potassium carbonate, trisodium phosphate, and sodium metaborate.

For the purpose of decreasing the formation of fog (Dmin) the developing solution may further contain an inorganic anti-fogging agent such as a bromide e.g. potassium bromide and/or an organic anti-fogging agent such as a benzimidazole e.g. 5-nitro-benzimidazole, a benzotriazole like benzotriazole itself and 5-methyl-benzotriazole.

The developing solution may contain other ingredients such as i.a. toning agents, development accelerators, oxidation preservatives, surface-active agents, defoaming agents, water-softeners, anti-sludge agents/hardeners including latent hardeners, and viscosity-adjusting agents.

Regeneration of the developing solution according to known methods is, of course, possible.

The development may be stopped—though this is often not necessary—with an aqueous solution having a low pH. An aqueous solution having a pH not higher than 3.5 comprising e.g. acetic acid and sulphuric acid, and containing a buffering agent is preferred.

Buffered stop bath compositions comprising a mixture of sodium dihydrogen orthophosphate and disodium hydrogen orthophosphate are preferred.

Conventional fixing solutions may be used. Examples of useful fixing agents include organic sulphur compounds known as fixing agents, as well as a thiosulphate, a thiocyanate, etc. The fixing solution may contain a water-soluble aluminium salt as a hardening agent.

The stopping solution may be an aqueous solution having a low pH. An aqueous solution having a pH not higher than 3.5 comprising e.g. acetic acid and sulphuric acid, and containing a buffering agent is preferred.

Suitable additives for improving the dimensional stability of the photographic material can also be incorporated therein together with the hydrophilic colloid binder of the silver halide emulsion. Suitable examples of this type of compounds include i.a. dispersions of a water-soluble or hardly soluble synthetic polymer e.g. polymers of alkyl (meth) acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth) acrylates, and styrene sulphonic acids.

Various compounds can be added to the photographic emulsion to prevent the reduction in sensitivity or fog formation during preparation, storage, or processing of the photographic material. A great many compounds are known for these purposes, and they include homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups e.g. 4-hydroxy-6-methyl- 1,3,3a,7-tetra-azaindene Compounds of this kind have been described by Birr in Z. Wiss. Photogr. Photophys. Photochem. 47, 2–27 (1952). Other suitable stabilizers are i.a. heterocyclic mercapto compounds e.g. 1-phenyl-5-mercaptotetrazole-methyl-benzothiazole, quaternary benzothiazole derivatives, benzotriazole. Specific examples of stabilizers have been mentioned by K. Mees in The Theory of the Photographic Process, 3rd ed. 1966 by reference to the papers that first reported such compounds.

The silver halide emulsions may comprise other ingredients e.g. development accelerators, wetting agents, and hardeners. The hydrophilic colloid binder of the silver halide emulsion layer and/or of other hydrophilic colloid layers can, especially when the binder used is gelatin, be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts and the phosphorus compounds described in EP-A 00 408 143.

The photographic light-sensitive materials of the present invention may contain a water-soluble dye in a hydrophilic colloid layer as a filter dye or for other various purposes such as for the prevention of irradiation or anti-halation. Such dyes include oxonol dyes, hemioxonol dyes, styryl dyes, merocyanine dyes, cyanine dyes, and azo dyes. Of these, oxonol dyes, hemioxonol dyes, and merocyanine dyes are useful.

When a hydrophilic colloid layer of the photographic light-sensitive materials of the present invention contain a dye or an UV-absorbing agent, these compounds may be mordanted by means of a cationic polymer e.g. polymers described in GB-A 1,468,460 and 685,475, U.S. Pat. Nos. 2,675,316, 2,839,401, 2,882,156, 3,048,487, 3,184,309, 3,445,231, and 3,986,875, DE-A 1,914,362.

The photographic light-sensitive materials of the present invention may comprise various kinds of surface-active agents or plasticizers in the photographic emulsion layer or in at least one other hydrophilic colloid layer. Suitable surface-active agents or plasticizers include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phosphor sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents or plasticizers can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast and development acceleration.

Development acceleration can be accomplished with the aid of various compounds, preferably polyalkylene derivatives having a molecular weight of at least 400 such as those described in e.g. U.S. Pat. Nos. 3,038,805, 4,038,075, and 4,292,400.

The photographic light-sensitive materials of the present invention may further comprise various other additives such as e.g. UV-absorbers, matting agents or spacing agents, and lubricants.

Suitable UV-absorbers are i.a. aryl-substituted benzotriazole compounds as described in U.S. Pat. No. 3,533,794, 4-thiazolidone compounds as described in U.S. Pat. No 3,314,794 and 3,352,681, benzophenone compounds as described in JP-A 2784/71, cinnamic ester compounds as described in U.S. Pat. No. 3,705,805 and 3,707,375, butadiene compounds as described in U.S. Pat No. 4,045,229, and benzoxazole compounds as described in U.S. Pat. No 3,700,455.

Suitable spacing agents are e.g. finely divided silica particles and polymer beads as described U.S. Pat. No. 4,614,708.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

A matting agent and/or a lubricant may be added to an emulsion layer and/or the protective hydrophilic colloid layer of the photographic light-sensitive materials of the present invention. Suitable matting agents are e.g. water-dispersible vinyl polymers such as poly(methyl methacrylate) having an appropriate particle size of from 0.2 to 6 μm and inorganic compounds e.g. silver halide and strontium barium sulphate. The lubricant is used to improve the slidability of the photographic material. Suitable examples of lubricants are e.g. liquid paraffin, waxes such as esters of higher fatty acids, polyfluorinated hydrocarbons or derivatives thereof, silicones such as polyalkylpolysiloxanes, polyarylpolysiloxanes, polyalkylarylpolysiloxanes and alkyleneoxide addition derivatives thereof.

The protective hydrophilic colloid layer of the photographic light-sensitive materials of the present invention preferably is a gelatin layer that also comprises silica as spacing agent and one of the above-mentioned plasticizers.

A variety of photographic supports can be employed for the photographic light-sensitive materials of the present invention. The silver halide emulsion can be coated onto one side or both sides of the support. Suitable supports are e.g. cellulose acetate films such as cellulose triacetate film and cellulose diacetate film, cellulose nitrate films, polyethylene terephthalate films, and polystyrene films.

In the first step for making a direct-positive or a negative image according to the method of the present invention the photographic light-sensitive materials are exposed image-wise. This exposure can either be a high-intensity exposure such as a flash exposure or a normal intensity exposure such as a daylight exposure, a low-intensity exposure such as an exposure by means of a printer, or an exposure of even lower intensity. The light source used for the exposure should match the wavelength sensitivity of the light-sensitive material. Natural light (sunlight), the light emitted by an incandescent lamp, a halogen lamp, a mercury vapour lamp, a fluorescent tube, a cathode ray tube (CRT), an electronic flash lamp, or by a metal-burning flash bulb can be used. Gas-, dye- or semiconductor lasers emitting light in the wavelength ranges from ultraviolet to infrared as well as a plasma light source are also suitable light sources for exposing the photographic light-sensitive silver halide materials for use in the method of the present invention. A line-shaped light source or a planar light source as well as a microshatter arrangement with a fluorescing area (CRT, etc.), the fluorescence of which is produced by fluorescing substances stimulated by means of electron beams, or even a liquid-crystal display (LCD) or a lanthanum-doped lead-titanium zirconate (PLZT) can be used as well as light sources for exposing the photographic light-sensitive silver halide materials for use in the method of the present invention. If necessary, the spectral distribution of the exposure light can be controlled by means of a colour filter.

In a second step for making a direct-positive or negative image the image-wise exposed silver halide material is soaked with, e.g. immersed in, a developing solution. For instance, the image-wise exposed silver halide material is conducted through a tray containing a developing solution.

The developing agents may be incorporated partially or completely into the photographic light-sensitive silver halide materials. They may be incorporated during the preparation stage of the material or at a later stage by means of a processing liquid with which the photographic material is wet prior to the development of the direct-positive or negative image. In this way the surface developer can be reduced to a mere alkaline liquid that is substantially free from developing agents. Such an alkaline aqueous liquid, often called "activator" offers the advantage of having a longer activity i.e. of being less rapidly exhausted. The preliminary processing liquid may contain at least a part of the nucleator quantity or nucleator precursor quantity required, optionally in the presence of one or more nucleator, and may also contain other ingredients that otherwise would have been incorporated into the developing solution. Wetting of the photographic material by means of a processing liquid comprising development nucleator or nucleator precursor and/or density-increasing compound may be performed according to any conventional method such as by soaking or by moistening one single side of the material e.g. by means of a lick roller, by spreading a paste e.g. contained in a pod, or by spraying.

The photographic light-sensitive silver halide materials used in the method of the present invention may serve different purposes. Application fields, in which direct-positive or negative images can be made in accordance with the present invention, are i.a. graphic arts recording processes, silver salt diffusion transfer reversal processes, microfilm recording processes, duplicating processes for cinematographic black-and-white negatives, laser recording processes, cathode-ray recording processes, fototype-setting processes, etc.

It is clear that the presence of the active compounds as nucleating agents during the formation of direct-positive or negative images according to this invention has the advantage that said compounds are more stable than e.g. propargylammonium salts, thanks to the incorporation of both the double bonds in the "tetrahydropyridinium ring" in aromatic rings.

A more favourable redox potential with compounds according to the present invention may explain the lower minimum densities achievable with photographic light-sensitive silver halide materials containing these compounds compared with those containing propargylammonium compounds.

The present invention will be explained in greater detail by reference to the following examples. The present invention should, however, not be construed as being limited thereto.

6. EXAMPLES

Examples 1 to 11

An emulsion A was prepared in the following manner:

Emulsion A:

An emulsion of cubic silver bromide with an average grain diameter of 0.24 μm was produced by simultaneous addition of 2.93M aqueous solutions of potassium bromide and silver nitrate to an aqueous gelatin solution of at 60° C. over a period of 40.8 minutes at a pAg of 7. $2.58\times10^{-5}$ moles of sodium thiosulfate per mole of AgBr, $1.63\times10^{-5}$ moles of chloroauric acid per mol AgBr and $2.75\times10^{-5}$ moles of sodium p-toluene-thiosulfonate per mole of AgBr were then added and the emulsion was chemically sensitized for 2 hours at 60° C. at a pAg of 7. The chemically sensitized silver bromide grains thus produced were used as cores for the further precipitation of silver bromide by the simultaneous addition of 2.93M aqueous solutions of potassium bromide and silver nitrate at 60° C. for 20 minutes at a pAg of 7, ultimately producing an internally ripened monodisperse core/shell emulsion of cubic silver bromide grains with an average diameter of 0.3 μm. After washing with water and desalting, $1.37\times10^{-5}$ moles of sodium thiosulfate per mole of AgBr, $2.47\times10^{-6}$ moles of chloroauric acid per mole of AgBr, $2.68\times10^{-5}$ moles of ammonium thiocyanate per mole of AgBr and $1.62\times10^{-6}$ moles of sodium p-toluene thiosulfonate per mole of AgBr were added and chemical sensitization carried out for 3.5 hours at 46° C., a pAg of 7.8 and a pH of 5.2, so giving an internal latent image emulsion A.

Emulsion A was divided into separate parts to which the amounts indicated in Table 1 of nucleating agents of the present invention and comparative nucleating agents A to C (as shown below) were added:

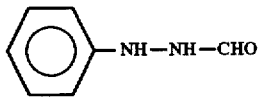

A

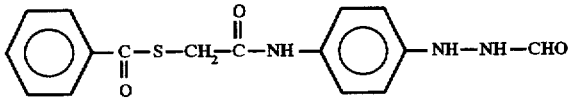

B

-continued

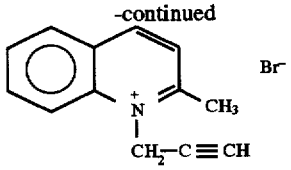

C

The following ingredients were also added: 1.7 moles per mole of silver bromide of the illustrated compound SO1 as a sensitizing dye.

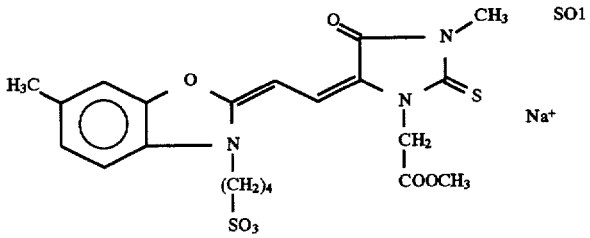

SO1 ammonium perfluoro-octanoate as a wetting agent and thickeners so as to achieve the required coating viscosity. In addition a solution of gelatin, amonium perfluoro-octanoate (as a wetting agent) and formaldehyde (as a hardener) was prepared for the coating of a protective antistress layer.

The layers of examples 1 to 11 were prepared by coating the solution for the protective antistress layer together with the emulsion layer using a simultaneous coating process to give a quantity of coated silver bromide of ca. 4.1 g per square meter on a polyethylene terephthalate film.

These samples were either exposed for $3\times10^{-5}$ s to a CRT light source with a $\lambda_{max}$ of ca. 450 nm via step wedge or for $1\times10^{-5}$ s with a xenon flash light source, supplied by EG&G Inc., 45 William Street, Wellesley, Mass. 02181, USA) through a D=1.60 optical density grey filter and then developed with the developers, the development temperatures, the development times and at the pH's given in Table 1.

Developer A is a high pH hydroquinone-type developer comprising the following ingredients:

| | |
|---|---|
| demineralized water | 500 mL |
| hydroquinone | 40 g |
| N-methyl-p-aminophenol sulfate | 15 g |
| sodium sulfite | 110 g |
| sodium hydroxide | 19 g |
| sodium carbonate | 40 g |
| 2-methylaminoethanol | 40 mL |
| tetrasodium salt of ethylene-diaminetetraacetic acid | 1 g |
| made up to 1 L with demineralized water (pH-value:11.3). | |

Developer B is a lower pH hydroquinone-type developer comprising the following ingredients:

| | |
|---|---|
| demineralized water | 192 mL |
| potassium hydroxide | 14.16 g |
| tetrasodium salt of ethylene-diaminetetraacetic acid | 0.92 g |
| potassium sulfite | 81.88 g |
| diethylene glycol | 20 mL |
| hydroquinone | 26.25 g |
| hydroxymethyl-methylphenidone | 2.75 g |
| potassium carbonate | 16.26 g |
| potassium bromide | 10 g |
| made up to 1 L with demineralized water (pH-value 10.90). | |

Developer C is the classical MAA1 metol-ascorbic acid developer comprising the following ingredients:

| | |
|---|---|
| metol | 2.5 g |
| ascorbic acid | 10 g |
| potassium metaborate (KBO2) | 35 g |
| potassium bromide | 1 g |
| made up to 1 L with demineralized water (pH-value 9.6). | |

The $D_{max}$, $D_{min}$ values, the speed (evaluated at a density level of 0.1 above $D_{min}$) and the exposure latitude (evaluated at a density of 0.1 above $D_{min}$) obtained with the samples are listed in Table 1. The values given for speed are expressed in log E. The higher the speed value the higher the speed.

In Table 1 the concentration of nucleating agent (Conc.Nucl.Agent) is expressed in μmole per 100 g of silver nitrate.

TABLE 1

| Sample No. | Nucl. Agent | Conc. Nucl. Agent | Developer | Dev. pH | Dev. Temp. [°C.] | Dev. Time [s] | Light source | $D_{max}$ | $D_{min}$ | Speed |
|---|---|---|---|---|---|---|---|---|---|---|
| 1 | A | 3900 | A | 11.3 | 35 | 29 | CRT | 2.1 | 0.12 | 43 |
| 2 | B | 50 | A | 11.3 | 35 | 33 | CRT | 1.95 | 0.09 | 52 |
| 3 | C | 10 | A | 11.3 | 35 | 19 | CRT | 2.0 | 0.4 | <5 |
| 4 | I.1 | 50 | A | 11.3 | 35 | 30 | CRT | 1.9 | 0.03 | 55 |
| 5 | B | 500 | B | 10.9 | 40 | 53 | CRT | 2.2 | 0.12 | 45 |
| 6 | C | 10 | B | 10.9 | 40 | 40 | CRT | 2.1 | 0.8 | 50 |
| 7 | C | 50 | B | 10.9 | 40 | 23 | CRT | 1.8 | 0.25 | 30 |
| 8 | I.1 | 200 | B | 10.9 | 38 | 30 | CRT | 2.08 | 0.04 | 42 |
| | | | | | 36 | 35 | CRT | 2.03 | 0.04 | 40 |
| 9 | A | 3900 | C | 9.6 | 35 | 900 | EG&G | 0.1 | 0.04 | — |
| 10 | C | 50 | C | 9.6 | 35 | 900 | EG&G | 2.0 | 0.2 | — |
| 11 | I.1 | 200 | C | 9.6 | 35 | 900 | EG&G | 2.1 | 0.03 | — |

The results in Table 1 show that the nucleating agents of the present invention when incorporated in a silver halide photographic material exhibit nucleating activity even in developers with a pH of 9.6 unlike hydrazides, without the loss in image discrimination (as seen by $D_{min}$ increase) observed with the comparative nucleating agent C (N-propargyl quinaldine bromide, an N-propargyl hetero aromatic cyclic compound). Furthermore, materials incorporating nucleating agents according to the present invention exhibit comparable sensitivities to those incorporating hydrazide nucleating agents.

Examples 12 to 14

The layers used in examples 12 to 14 were prepared as described for examples 1 to 11 except that no nucleating agent was added to the emulsion. These layers were exposed and developed as described for examples 1 to 11 except that nucleating agent was added to the developer used, the nucleating agent used together with the quantity per liter of developer added are given in Table 2 together with the development conditions and the photographic results.

TABLE 2

| Sample No. | Nucl. Agent | Conc. Nucl. Agent | Developer | Dev. pH | Dev. Temp. [°C.] | Dev. Time [s] | Light source | $D_{max}$ | $D_{min}$ | Speed |
|---|---|---|---|---|---|---|---|---|---|---|
| 12 | A | 0.2 | A | 11.3 | 35 | 22 | EG&G | 2.15 | 0.13 | 35 |
| 13 | I.1 | 0.0125 | A | 11.3 | 35 | 22 | CRT | 2.10 | 0.10 | 20 |
| 14 | I.1 | 0.0125 | C | 9.6 | 35 | 900 | EG&G | 2.8 | 0.25 | |

The results in Table 2 show that the nucleating agents of the present invention are active even in developers with a pH of 9.6 at very low concentrations.

We claim:

1. Photographic light-sensitive silver halide material, said material comprising a support and in at least one light-sensitive emulsion layer, dispersed in a hydrophilic colloid binder and/or in a hydrophilic colloid layer in water-permeable relationship with said emulsion layer, development-nucleating amounts ranging from about $10^{-5}$ to about $10^{-1}$ mole per mole of silver halide of at least one compound corresponding to at least one of the general formulae I to III,

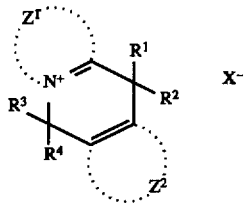

(I)

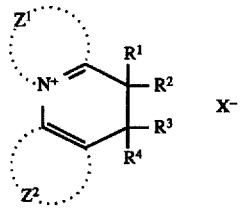

(II)

-continued (III)

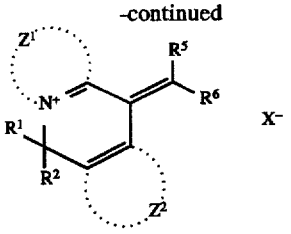

wherein:

$Z^1$ represents the carbon atoms necessary to complete a conjugated nucleus containing from 5 to 6 atoms including the quaternary nitrogen atom;

$Z^2$ represents the carbon atoms necessary to complete a conjugated ring;

$R^1$, $R^2$, $R^3$, $R^4$, $R^5$ and $R^6$ are independently an alkyl, amino, acyl, carboxy, sulfonyl, halide, sulfinyl group or hydrogen with the proviso that at least one of $R^1$ and $R^2$; at least one of $R^3$ and $R^4$ at least and one of $R^5$ and $R^6$ is hydrogen.

2. A photographic light-sensitive silver halide material according to claim 1, wherein in the compounds according to the formulae (I), (II) and (III) at least one of $Z^1$ and $Z^2$ are ring systems substituted with a group containing a blocked silver halide adsorbing group, which is rapidly deblocked in alkaline developers by hydrolysis due to the action of hydroxyl ions present therein.

3. A photographic light-sensitive silver halide material according to claim 2, wherein said blocked silver halide adsorbing group is represented by formula IV:

$$—R^7—S—R^8 \qquad \text{IV}$$

wherein $R^7$ represents —NH—CO—$CH_2$; —CO—$CH_2$; —NH—$CH_2$—; —NH—$SO_2$—$CH_2$—;

$R^8$ represents a thiocarbamide group, a carbamide group and an acyl group.

4. A photographic light-sensitive silver halide material according to claim 1, wherein said compound corresponds to the Formula I.1 or Formula I.2

I.1

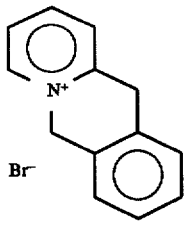

-continued

I.2

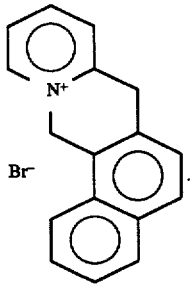

5. A photographic light-sensitive silver halide material according to claim 1, wherein said image forming silver halide grains are core-shell grains.

6. A photographic light-sensitive silver halide material according to claim 5 wherein the core of said core-shell grains is chemically ripened.

7. A photographic light-sensitive silver halide material according to claim 1, wherein said silver halide grains are doped with a polyvalent metal dopant.

8. A photographic light-sensitive silver halide material according to claim 7, wherein said polyvalent metal dopant is chosen from group VIII of the Periodic Table.

9. A photographic light-sensitive silver halide material according to claim 1, wherein said material is a direct-positive material comprising unfogged internal latent image-type silver halide grains in at least one light-sensitive silver halide layer.

10. A photographic light-sensitive silver halide material according to claim 1, wherein said material is a negative working lithographic material comprising surface latent-type silver halide grains in at least one light-sensitive halide layer.

* * * * *